US010094561B2

(12) United States Patent
Hanson

(10) Patent No.: US 10,094,561 B2
(45) Date of Patent: Oct. 9, 2018

(54) METHOD AND SYSTEM FOR A BURN PROOF LIGHTER WITH A COLLAPSIBLE CERAMIC TIP

(71) Applicant: Tyler Dean Hanson, Fallbrook, CA (US)

(72) Inventor: Tyler Dean Hanson, Fallbrook, CA (US)

(73) Assignee: Tyler Dean Hanson, Fallbrook, CA (US)

( * ) Notice: Subject to any disclaimer, the term of this patent is extended or adjusted under 35 U.S.C. 154(b) by 483 days.

(21) Appl. No.: 14/666,867

(22) Filed: Mar. 24, 2015

(65) Prior Publication Data

US 2016/0281985 A1 Sep. 29, 2016

(51) Int. Cl.

| | |
|---|---|
| ***H05B 1/02*** | (2006.01) |
| ***F23Q 7/16*** | (2006.01) |
| ***F23Q 7/24*** | (2006.01) |
| ***H05B 3/14*** | (2006.01) |
| ***H05B 3/44*** | (2006.01) |

(52) U.S. Cl.

CPC ..... *F23Q 7/16* (2013.01); *F23Q 7/24* (2013.01); *H05B 1/0252* (2013.01); *H05B 3/141* (2013.01); *H05B 3/44* (2013.01)

(58) Field of Classification Search

CPC ..... F23Q 7/16; F23Q 7/24; H05B 1/0252; H05B 3/141; H05B 3/44; H01J 7/0045; H01J 7/0047

USPC ..... 219/267, 270, 494; 131/728, 729, 237

See application file for complete search history.

(56) References Cited

U.S. PATENT DOCUMENTS

| | | | | |
|---|---|---|---|---|
| 7,586,063 | B1 * | 9/2009 | Wilbon | F23Q 7/16 219/260 |
| 8,008,604 | B2 * | 8/2011 | Tsang | F24C 7/105 219/494 |
| D678,602 | S | 3/2013 | Melograno | D27/152 |
| 2007/0045276 | A1 * | 3/2007 | Fisher | F23Q 7/16 219/268 |
| 2014/0138371 | A1 * | 5/2014 | Sardar | F23Q 7/00 219/209 |
| 2014/0217085 | A1 * | 8/2014 | Alima | F23Q 7/16 219/474 |
| 2015/0141093 | A1 * | 5/2015 | Sela | H04B 1/3888 455/575.8 |
| 2015/0289718 | A1 * | 10/2015 | Gross | A47J 37/079 126/25 B |

* cited by examiner

*Primary Examiner* — Mark Paschall

(74) *Attorney, Agent, or Firm* — Gordon IP Law, PLLC

(57) ABSTRACT

Methods and systems for a burn proof lighter with a collapsible ceramic tip may include extending, with a switch module, a ceramic heating element beyond a body of an electronic lighter. The method may include adjusting, with a temperature switch, a temperature of the ceramic heating element, wherein the temperature switch may include multiple pre-defined temperature settings. The method may include retracting, with the switch module, the ceramic heating element into the body of the electronic lighter. In an embodiment, the switch module may include a sliding switch. Additionally, the temperature switch may include a plus button and a minus button. In a further embodiment, the multiple pre-defined temperature settings may include a vapor setting, a thick vapor setting, a combustion setting, or a butane lighter setting. In an embodiment, the pre-defined temperature settings may include a low temperature setting, a medium temperature setting, and a high temperature setting.

13 Claims, 6 Drawing Sheets

METHOD AND SYSTEM FOR A BURN PROOF LIGHTER WITH A COLLAPSIBLE CERAMIC TIP

FIELD

This disclosure relates generally to electronic lighters, and more specifically, to a method and system for a burn proof lighter with a collapsible ceramic tip.

BACKGROUND

Lighters may be used to ignite cigarettes, firecracker fuses, and smoking apparatuses. Conventional liquid-based cigarette lighters typically include a liquid hydrocarbon source, such as butane. Inhalation of butane can cause health problems by interfering with the lungs and/or heart. Additionally, butane and other hydrocarbons are considered to be "fossil fuels". The combustion of butane produces carbon dioxide, a greenhouse gas that contributes to global warming. Furthermore, liquid-based lighters are prone to the effects of wind since liquid lighters typically produce an exposed flame that may be unexpectedly extinguished by strong breezes.

Electronic lighters include a resistive heating element coupled to a heat conductive contact module, such as a metal plate or ceramic tip. Electronic lighters are not prone to the effects of wind. However the heat conductive contact modules of electronic lighters typically stay hot for a length of time after the power has been switched off. The hot heating elements of electronic lighters can cause personal injury and also may pose as a fire hazard. For example, property damage and/or personal injury may occur when an electronic lighter has been switched off yet is still hot and is then inadvertently knocked over onto an object or brushed against the skin of a user if dropped.

SUMMARY

Methods and systems for a burn proof lighter with a collapsible ceramic tip are disclosed. In an embodiment, a method may include extending, with a switch module, a ceramic heating element beyond a body of an electronic lighter. The method may also include adjusting, with a temperature switch, a temperature of the ceramic heating element, wherein the temperature switch may include multiple pre-defined temperature settings. Additionally, the method may include retracting, with the switch module, the ceramic heating element into the body of the electronic lighter. In an embodiment, the switch module may include a sliding switch configured to extend the ceramic heating element in response to an upward force applied to the sliding switch by the user and retract the ceramic heating element automatically in response to the upward force being removed or decreasing below a threshold value. In one embodiment, the switch module may include a spring activated push button module. Additionally, the temperature switch may include a plus button and a minus button.

In a further embodiment, the multiple pre-defined temperature settings may include a vapor setting, a thick vapor setting, a combustion setting, or a butane lighter setting. In an embodiment, the multiple pre-defined temperature settings may include a low temperature setting, a medium temperature setting, and a high temperature setting. Additionally, the multiple pre-defined temperature settings may include a customizable range of temperature setting values.

A system for a burn proof lighter with a collapsible ceramic tip may include a switch module configured to extend a ceramic heating element beyond a body of an electronic lighter and retract the ceramic heating element into the body of the electronic lighter. In an embodiment, the system may include a temperature switch configured to adjust a temperature of the ceramic heating element, wherein the temperature switch may include multiple pre-defined temperature settings. In one embodiment, the switch module may include a sliding switch configured to extend the ceramic heating element in response to an upward force applied to the sliding switch by the user and retract the ceramic heating element automatically in response to the upward force being removed or decreasing below a threshold value. In another embodiment, the switch module may include a spring activated push button module. In yet another embodiment, the switch module may include a hybrid module including both a sliding switch module and a spring activated module, where the spring activated module may include one or more springs configured to stretch when the ceramic heating element is extended and/or to automatically contract in response to a sudden shock, jolt, or the like, thereby automatically withdrawing the ceramic heating element safely back into the lighter body if the lighter is accidentally dropped. Additionally, the temperature switch may include a plus button and a minus button. In a further embodiment, the multiple pre-defined temperature settings may include a vapor setting, a thick vapor setting, a combustion setting, or a butane lighter setting. In an embodiment, the multiple pre-defined temperature settings may include a low temperature setting, a medium temperature setting, and a high temperature setting. Additionally, the multiple pre-defined temperature settings may include a customizable range of temperature setting values.

An apparatus for a burn proof lighter with a collapsible ceramic tip may include a switch module configured to extend a ceramic heating element beyond a body of an electronic lighter and retract the ceramic heating element into the body of the electronic lighter. In an embodiment, the system may include a temperature switch configured to adjust a temperature of the ceramic heating element, wherein the temperature switch may include multiple pre-defined temperature settings. In one embodiment, the switch module may include a sliding switch configured to extend the ceramic heating element in response to an upward force applied to the sliding switch by the user and retract the ceramic heating element automatically in response to the upward force being removed or decreasing below a threshold value. In another embodiment, the switch module may include a spring activated push button module. Additionally, the temperature switch may include a plus button and a minus button. In a further embodiment, the multiple pre-defined temperature settings may include a vapor setting, a thick vapor setting, a combustion setting, or a butane lighter setting. In an embodiment, the multiple pre-defined temperature settings may include a low temperature setting, a medium temperature setting, and a high temperature setting. Additionally, the multiple pre-defined temperature settings may include a customizable range of temperature setting values.

BRIEF DESCRIPTION OF THE DRAWINGS

The present invention(s) is/are illustrated by way of example and is/are not limited by the accompanying figures, in which like references indicate similar elements. Elements in the figures are illustrated for simplicity and clarity, and have not necessarily been drawn to scale.

DETAILED DESCRIPTION

Figure 1:
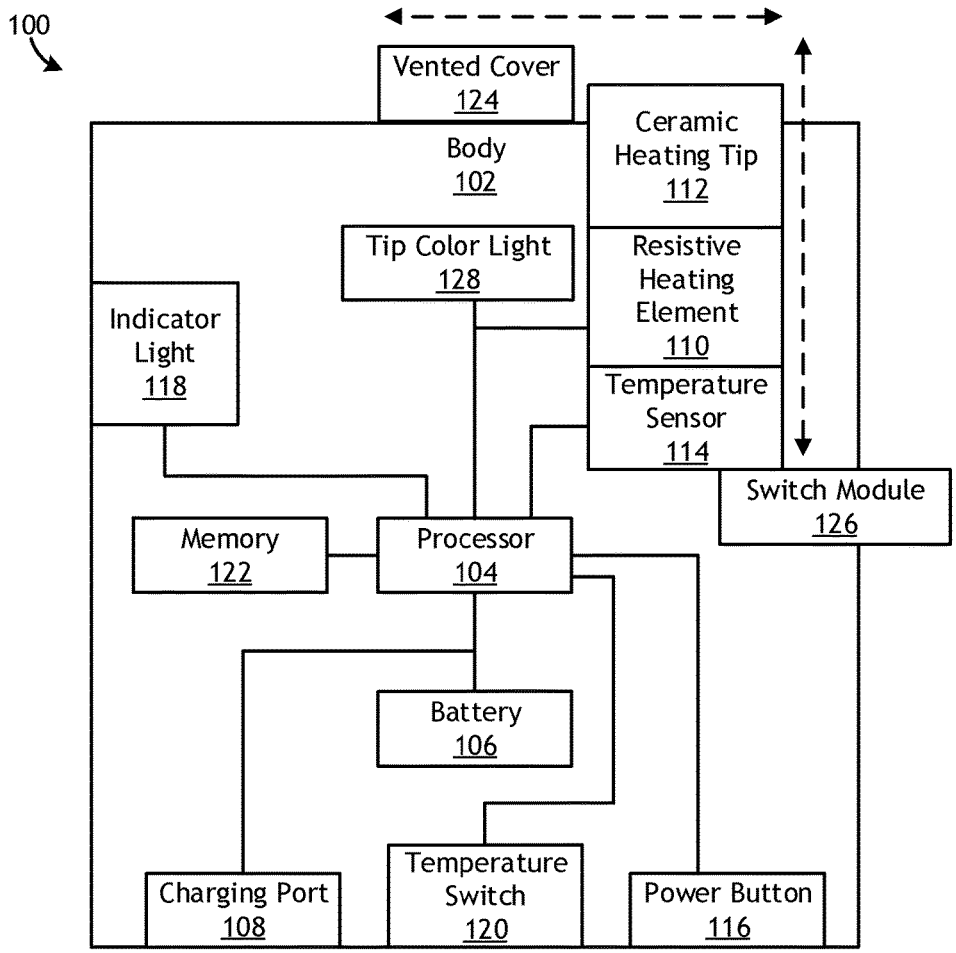
FIG. 1 is a schematic block diagram illustrating one embodiment of a system for a burn proof lighter with a collapsible ceramic tip.

Embodiments of methods and systems for a burn proof lighter with a collapsible ceramic tip are described. In an embodiment, an electronic lighter with multiple pre-programmed temperature settings includes a ceramic tipped heating element that may be extended during use and withdrawn inside the body of the lighter after use to increase safety.

In one embodiment, an electronic lighter includes a power button, a rechargeable battery, a charging port, an adjustable temperature switch, and an extendible and collapsible ceramic heating tip. In an embodiment the ceramic tip may be selectively extended or retracted via a sliding finger-activated switch on the side of the lighter. A user may slide the switch up to extend the heating element, and the user may release upward force from the switch and/or slide the switch down to retract the heating element back into a safe position within a burn-proof cavity in the body of the lighter. In another embodiment, the ceramic tip may be selectively extended or retracted via a spring-activated push button module. In yet another embodiment, the ceramic tip may be extended or retracted through the use of an integrated electronic motor-assisted push button module. In various embodiments the body of the lighter may have a cylindrical shape, a three-dimensional octagonal shape, a three-dimensional hexagonal shape, a three-dimensional oval shape, a three-dimensional "tear drop" shape, a sword handle shape, or the like.

In an embodiment, the electronic lighter having an extendable and collapsible ceramic heating tip may also include an adjustable temperature switch with multiple pre-defined temperature settings. In one embodiment the temperature switch may be adjusted by turning a swiveling switch module on the base of the lighter. In an embodiment, the pre-programmed temperature settings may correspond to different temperature levels suited for specific lighter applications. For example, the temperature switch may have a setting of three-hundred eighty (380) degrees Fahrenheit for "vape", a setting for four-hundred thirty (430) degrees Fahrenheit for "thick vape", a setting of seven-hundred fifty (750) degrees Fahrenheit for "combustion", and/or a setting of one-thousand four-hundred (1400) degrees Fahrenheit for "butane lighter". In other embodiments, the vape setting, the thick vape setting, the combustion setting, and/or the butane lighter setting may correspond to different numerical values of degrees Fahrenheit other than those listed above. In another embodiment, the electronic lighter may include a digital adjustable temperature switch configured to be set to any temperature value across a fully-customizable range of temperature values. In such an embodiment, a user may increase or decrease a numerical desired temperature setting value using "plus" and "minus" buttons configured to change the temperature setting value in single digit increments, "fast-forward" and/or "rewind" buttons configured to change the temperature setting value in increments larger than one degree Fahrenheit, and/or a "jump" button configured to change the temperature setting value in pre-defined increments (e.g., 100 degrees Fahrenheit). In various embodiments, the temperature switch thus enables the user to control the target temperature of the ceramic tipped heating element based on the desired application of the electronic lighter.

An electronic lighter with an adjustable temperature switch and a collapsible ceramic heating tip may operate on one or more rechargeable batteries, such as Lithium ion batteries. Since the user can recharge the batteries, the lighter's aggregate impact on the environment is reduced because disposable batteries are not necessary. Furthermore, the electronic lighter does not use butane or other hydrocarbons. As a result, the electronic lighter does not emit harmful fumes into user's lungs and/or cause harsh aftertastes during smoking. The adjustable temperature switch helps to conserve battery power while also increasing the efficiency of the lighter by enabling the user to select specifically-targeted temperatures depending on the intended use of the lighter for various applications. Additionally, the collapsible ceramic tip may be safely withdrawn into a burn-proof cavity inside the body of the lighter after use, thereby minimizing the risks of personal injury or property damage.

FIG. 1 is a schematic block diagram illustrating one embodiment of a system 100 for a burn proof lighter with a collapsible ceramic tip. As shown, the system 100 may include a body 102. In various embodiments, body 102 may be a metallic shell, a plastic shell, a composite shell, or the like. Similarly, body 102 may have a cylindrical shape, a three-dimensional octagonal shape, a three-dimensional hexagonal shape, a three-dimensional oval shape, a three-dimensional "tear drop" shape, a sword handle shape, or the like. In an embodiment, the system 100 may include a processor 104 coupled to a rechargeable battery 106 and a charging port 108. In one embodiment processor 104 may centrally distribute power from battery 106 to various components of system 100. In another embodiment battery 106 may be coupled directly to multiple components of system 100. In various embodiments charging port 108 may be a universal serial bus (USB) charging port, a direct current (DC) charging port, or the like.

In one embodiment, the system 100 may include a resistive heating element 110 coupled to a ceramic heating tip 112, such that ceramic heating tip 112 may distribute heat from resistive heating element 110. In an embodiment system 100 may also include a temperature sensor 114 coupled to resistive heating element 110 and/or ceramic heating tip 112. As depicted, ceramic heating tip 112, resistive heating element 110, and temperature sensor 114 are configured to be movable based on user input via a switch module 126, such that ceramic heating tip 112 may be extended outside body 102 or retracted inside body 102. Processor 104 may be configured to activate (i.e., turn on) resistive heating element 110 in response to user input via power button 116, indicator light 118, temperature switch 120, and/or the movement of ceramic heating tip 112 into an extended position. Resistive heating element 110 may thus be used to selectively heat ceramic heating tip 112, which in turn may enable a user to heat a cigarette or other smoking apparatus when ceramic heating tip 112 is extended outside body 102 by switch module 126. In one embodiment, a movable vented cover 124 may be attached to body 102, such that vented cover 124 may be selectively positioned over an opening in body 102 when ceramic heating tip 112 is retracted. Vented cover 124 may thus provide additional safety by preventing inadvertent contact between ceramic heating tip 112 and nearby objects and/or the skin of a user when ceramic heating tip 112 is in a retracted position, while simultaneously facilitating the safe cooling of ceramic heating tip 112 via air circulation through vented cover 124. In various embodiments, vented cover 124 may be a sliding mesh screen, a rotating mesh screen, a removable (e.g., snap on/off) vented cover, or the like.

In an embodiment, the system 100 may include a power button 116 coupled to processor 104 and an indicator light 118 coupled to processor 104, and a temperature switch 120 coupled to processor 104. In various embodiments indicator light 118 may be a light emitting diode (LED), an organic LED (OLED), an incandescent light source, or the like. In an embodiment, indicator light 118 may include user input functionality (e.g., as a light emitting push button or touch sensor). In one embodiment processor 104 may be configured to illuminate indicator light 118 in response to a user pressing power button 116 to turn on system 100. In another embodiment, processor 104 may be configured to selectively illuminate indicator light 118 and/or change the color of indicator light 118 in response to temperature sensor 114 sensing that resistive heating element 110 has reached a temperature value corresponding to a current setting of temperature switch 120. In yet another embodiment, processor 104 may be configured to selectively illuminate indicator light 118 in response to a power source being connected to charging port 108 and/or in response to battery 106 reaching a full charge level or a low charge level.

In one embodiment, processor 104 may be configured to activate (i.e., turn on) resistive heating element 110 and thus heat up ceramic heating tip 112 in response to a user pressing indicator light 118. In another embodiment, processor 104 may be configured to activate an "instant on" option in which ceramic heating tip 112 is heated by resistive heating element 110 to a current temperature setting of temperature switch 120 in response to a user pressing power button 116, pressing indicator light 118, and/or moving ceramic heating tip 112 into an extended position by interfacing with switch module 126. In yet another embodiment, processor 104 may be configured to "pre-heat" ceramic heating tip 112 via resistive heating element 110 prior to signaling the user to extend ceramic heating tip 112. In such an embodiment, processor 104 may be configured to set indicator light 118 to emit a first color (e.g., red) during the pre-heating process and then to set indicator light 118 to emit a second color (e.g., green) after the pre-heating is complete (i.e., when ceramic heating tip 112 has reached a temperature setting value corresponding to a current setting of temperature switch 120). Indicator light 118 may thus be used by processor 104 to signal the user when ceramic heating tip 112 has reached a desired temperature setting value and/or to signal to the user when it is ideal to manually extend ceramic heating tip 112. In an embodiment, processor 104 may be configured to automatically extend ceramic heating tip 112 via a spring-loaded or motor-driven mechanism in response to ceramic heating tip 112 reaching a temperature setting value corresponding to a setting of temperature switch 120. Similarly, in one embodiment, processor 104 may be configured to automatically retract ceramic heating tip 112 safely into body 102 in response to temperature sensor 114 detecting that ceramic heating tip 112 has reached a temperature value that exceeds a maximum temperature safety threshold. In an embodiment, switch module 126 may include a spring loaded module that automatically retracts ceramic heating tip 112 in response to a user removing upward force from switch module 126 and/or in response to a user decreasing upward force on switch module 126 to an amount of force that is below a pre-defined threshold value. In one embodiment, an upward force threshold value may correspond to an amount of upward force required to extend one or more spring modules connected to switch module 126. In such an embodiment, ceramic heating tip 112 may only be extended while a user is manually interfacing with system 100 via switch module 126, and the ceramic tip may be automatically withdrawn (i.e., safely retracted) by a spring loaded module if a user is not manually interfacing with system 100 via switch module 126.

Figure 2:
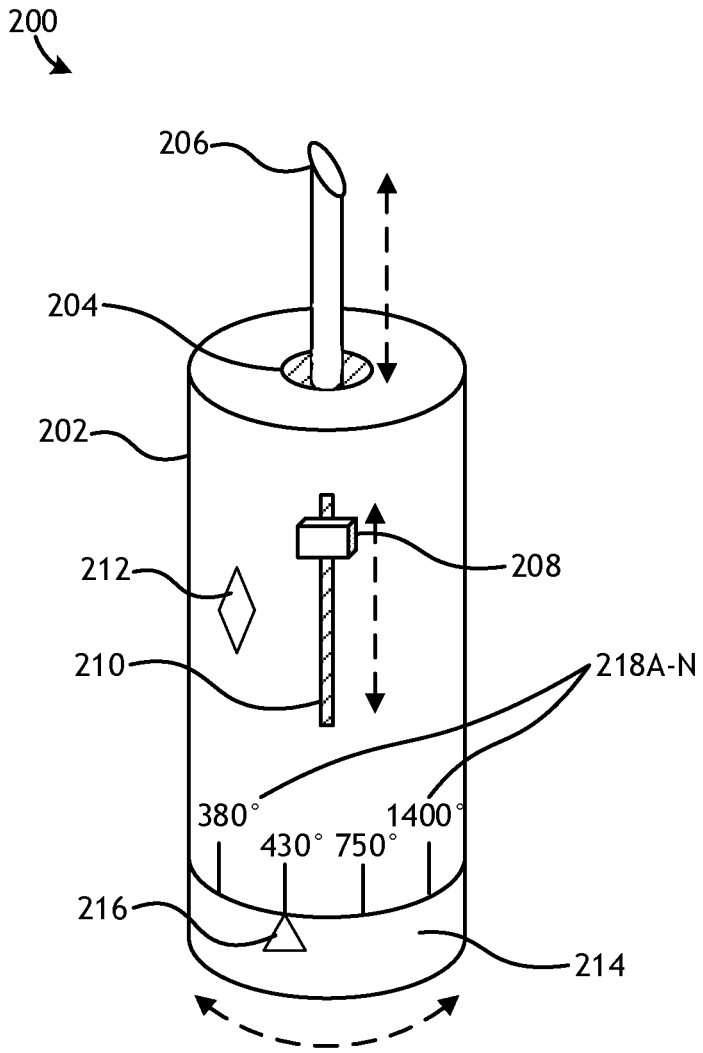
FIG. 2 is a schematic block diagram illustrating one embodiment of a system for a burn proof lighter with a collapsible ceramic tip.
Figure 3:
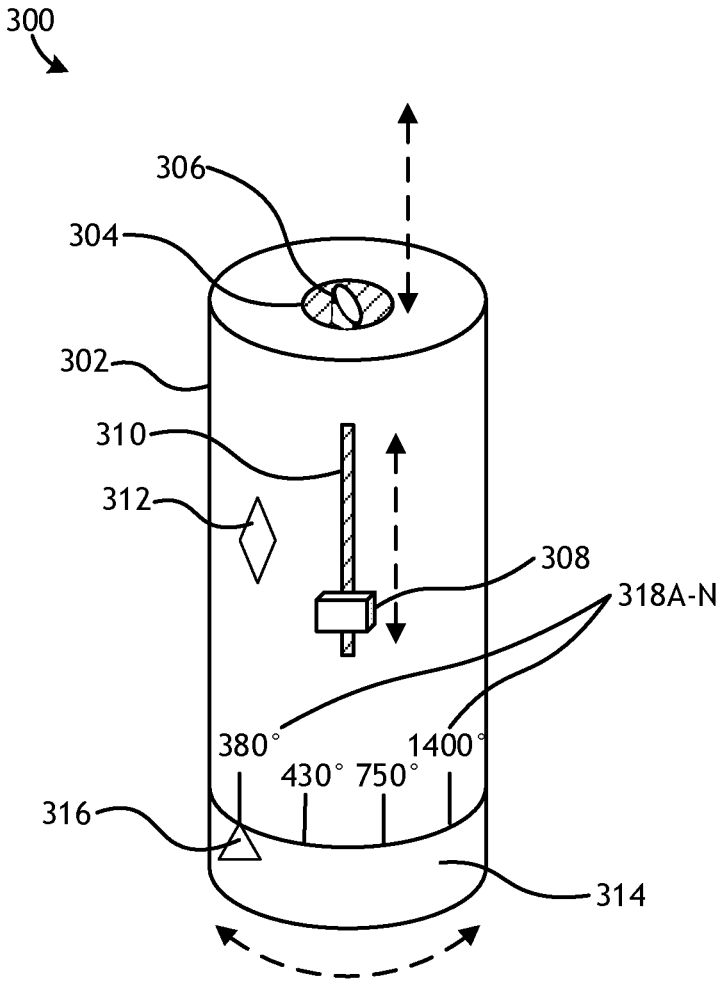
FIG. 3 is a schematic block diagram illustrating one embodiment of an apparatus for a burn proof lighter with a collapsible ceramic tip.

In an embodiment, temperature switch 120 may include multiple pre-defined temperature settings, as illustrated in FIG. 2 and FIG. 3. In various embodiments, memory 122 may store calibration data (e.g., calibration values resistive heating element 110 and/or temperature sensor 114), program instructions for processor 104, and/or pre-defined temperature setting data. In various embodiments, memory 122 may be implemented using any suitable processor-accessible memory technology, such as random access memory (RAM), static RAM (SRAM), read only memory (ROM), dynamic RAM (DRAM) synchronous dynamic RAM (SDRAM), nonvolatile/Flash-type memory, or any other type of memory.

In an embodiment, the system 100 may include a tip color light 128 configured to emit colored light in response to resistive heating element 110 being turned on (i.e., when ceramic heating tip 112 is being pre-heated and/or is heated). In various embodiments, tip color light 128 may include an LED module, an OLED module, an incandescent light module, or the like. In an embodiment, processor 104 may be configured to change the color of light emitted by tip color light 128 in response to data received from temperature sensor 114, thereby selectively emitting different colors of light as the temperature of ceramic heating tip 112 changes (e.g., during pre-heating and/or "ready" states). In another embodiment, ceramic heating tip 112 may emit light when heated based on the physical properties of the ceramic material and may thereby emit light without the assistance of a tip color light 128.

FIG. 2 is a schematic block diagram illustrating one embodiment of a system 200 for a burn proof lighter with a collapsible ceramic tip. In an embodiment, system 200 may be configured similarly to system 100 of FIG. 1. As depicted, the system 200 includes a body 202 having a cavity 204. The cavity 204 may be lined with one or more temperature insulating (i.e., burn-proof) materials, including, but not limited to, metal, glass, or ceramic compounds. In an embodiment, the top of cavity 204 may include a movable vented safety cover configured to selectively prevent accidental contact between ceramic heating tip and outside objects (e.g., clothing, furniture, skin, or the like) when ceramic heating tip is fully retracted into cavity 204. As shown, a ceramic heating element 206 is configured to be selectively extended at least partially outside cavity 204 and body 202 by a user interfacing with switch module 208.

Similarly, ceramic heating element 206 may be selectively retracted fully into cavity 204 by a user interfacing with switch module such that the end tip of ceramic heating element 206 does not extend beyond body 202. In one embodiment switch module 208 may include a sliding module configured to be guided along a slot 210. In another embodiment switch module 208 may include a spring activated push-button switch module. In yet another embodiment switch module 208 may include an electronically powered motor-assisted ceramic heating element movement module. In another embodiment, switch module 208 may include a hybrid module that includes both a sliding switch module and a spring activated module, where the spring activated module may include one or more springs configured to stretch when ceramic heating element 206 is extended and/or to automatically contract in response to a sudden shock, jolt, or the like, thereby automatically withdrawing ceramic heating element 206 safely back into body 202 if the lighter is accidentally dropped by a user. In one embodiment, switch module 208 may be configured to activate (i.e., initiate the heating of) ceramic heating element 206 in response to ceramic heating element 206 being moved by a user into an extended position. In various embodiments, ceramic heating element 206 may be activated in response to user input via temperature switch 214, indicator light 212, switch module 208, and or the power button 404 depicted in FIG. 4.

In one embodiment, ceramic heating element 206 may be removable. For example, a user may unscrew ceramic heating element 206 in order to repair or replace ceramic heating element 206. In an embodiment, ceramic heating element 206 may be configured to glow with a color when heated based on the material composition of ceramic heating element 206 and/or electronically powered light emitting elements coupled to ceramic heating element 206. A user may thus exchange (i.e., swap) a ceramic tip configured to glow red with a ceramic tip that is configured to glow blue by unscrewing one ceramic tip when the tip is in a safe (i.e., cooled) state and then screwing in another ceramic tip configured to glow a different color.

In an embodiment, the system 200 may include a power indicator light 212. Power indicator light 212 may be an LED light source, an incandescent light source, or the like. In one embodiment, indicator light 212 may include user interface functionality and may be configured to activate (i.e., initiate the heating of) ceramic heating element 206 in response to a user pressing, touching, and/or interfacing with indicator light 212. In various embodiments, power indicator light 212 may include a colored cover shaped as a diamond, a star, a flame design, illuminated text characters, or the like. In one embodiment, the system 200 may include a temperature switch 214. Temperature switch 214 may be a rotatable switch module having a position indicator mark 216. A user of system 200 may adjust the target temperature of ceramic heating element 206 by manipulating temperature switch 214 such that position indicator mark 216 points to one of pre-defined temperature settings 218A-N. In one embodiment, pre-defined temperature settings 218A-N may include a setting of three-hundred eighty (380) degrees Fahrenheit of "vape", a setting for four-hundred thirty (430) degrees Fahrenheit for "thick vape", a setting of seven-hundred fifty (750) degrees Fahrenheit for "combustion", and/or a setting of one-thousand four-hundred (1400) degrees Fahrenheit for "butane lighter". In other embodiments, the vape setting, the thick vape setting, the combustion setting, and/or the butane lighter setting may correspond to different numerical values of degrees Fahrenheit other than those listed above. In an embodiment, the pre-defined temperature settings 218A-N may include a "low" setting, a "medium" setting, and a "high" setting. In another embodiment, the pre-defined temperature settings 218A-N may include a user-customizable range of temperature values, and temperature switch 214 may be a digital interface configured to enable a user to increase or decrease a numerical temperature setting value using "plus" and "minus" buttons in single digit increments. In another embodiment, temperature switch 214 may include "fast-forward" and/or "rewind" buttons configured to change the temperature setting value in increments larger than one degree Fahrenheit, and/or a "jump" button configured to change the temperature setting value in pre-defined increments (e.g., 100 degrees Fahrenheit).

FIG. 3 is a schematic block diagram illustrating one embodiment of an apparatus 300 for a burn proof lighter with a collapsible ceramic tip. In an embodiment, apparatus 300 may be configured similarly to system 100 of FIG. 1. As depicted, the apparatus 300 includes a body 302 having a cavity 304. The cavity 304 may be lined with one or more temperature insulating (i.e., burn-proof) materials, including, but not limited to, metal, glass, or ceramic compounds. As shown, a ceramic heating element 306 is retracted fully into cavity 304 (i.e., in a "safe position") such that the end tip of ceramic heating element 306 does not extend beyond body 302. If a user desires to heat an object using apparatus 300, then the user may selectively extend ceramic heating element 306 at least partially outside cavity 304 and body 302 by interfacing with switch module 308. In one embodiment switch module 308 may include a sliding module configured to be guided along a slot 310. In an embodiment, the apparatus 300 may include a power indicator light 312. In one embodiment, the apparatus 300 may include a temperature switch 314. Temperature switch 314 may be a rotatable switch module having a position indicator mark 316. A user of apparatus 300 may adjust the target temperature of ceramic heating element 306 by manipulating temperature switch 314 such that position indicator mark 316 points to one of pre-defined temperature settings 318A-N.

Figure 4:
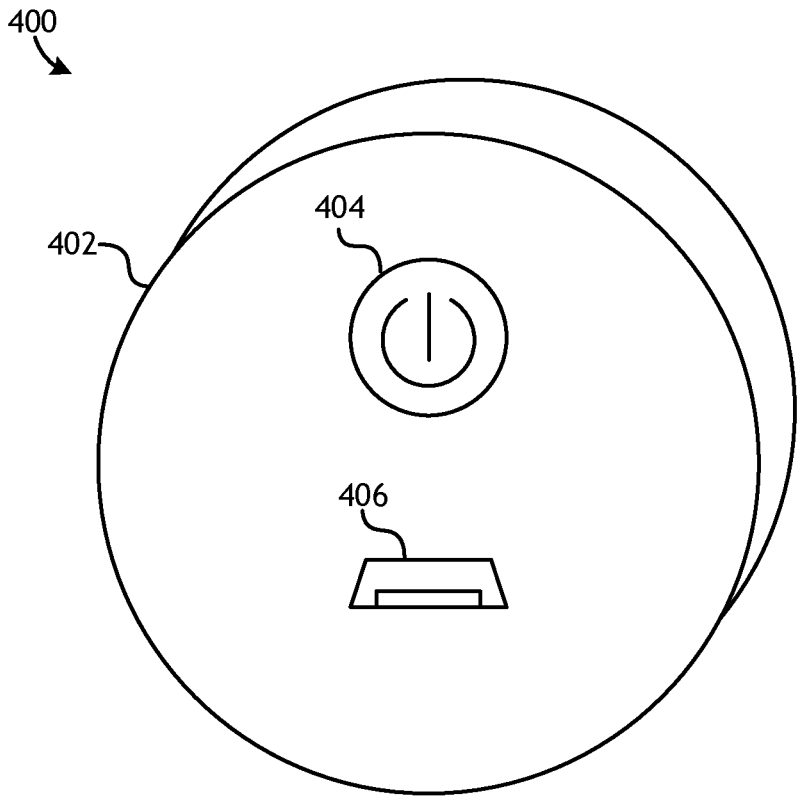
FIG. 4 is a schematic block diagram illustrating one embodiment of an apparatus for a burn proof lighter with a collapsible ceramic tip.

FIG. 4 is a schematic block diagram illustrating one embodiment of an apparatus 400 for a burn proof lighter with a collapsible ceramic tip. In one embodiment, apparatus 400 may be configured similarly to apparatus 300 of FIG. 3 or system 100 of FIG. 1. As shown, FIG. 4 provides a bottom view of apparatus 300 of FIG. 3. In an embodiment, the apparatus 400 may include a body 402, a power button 404, and a charging port 406. As depicted, power button 404 and charging port 406 may be located on a bottom face of body 402. In another embodiment power button 404 and/or charging port 406 may be located on a side of body 402.

Figure 5:
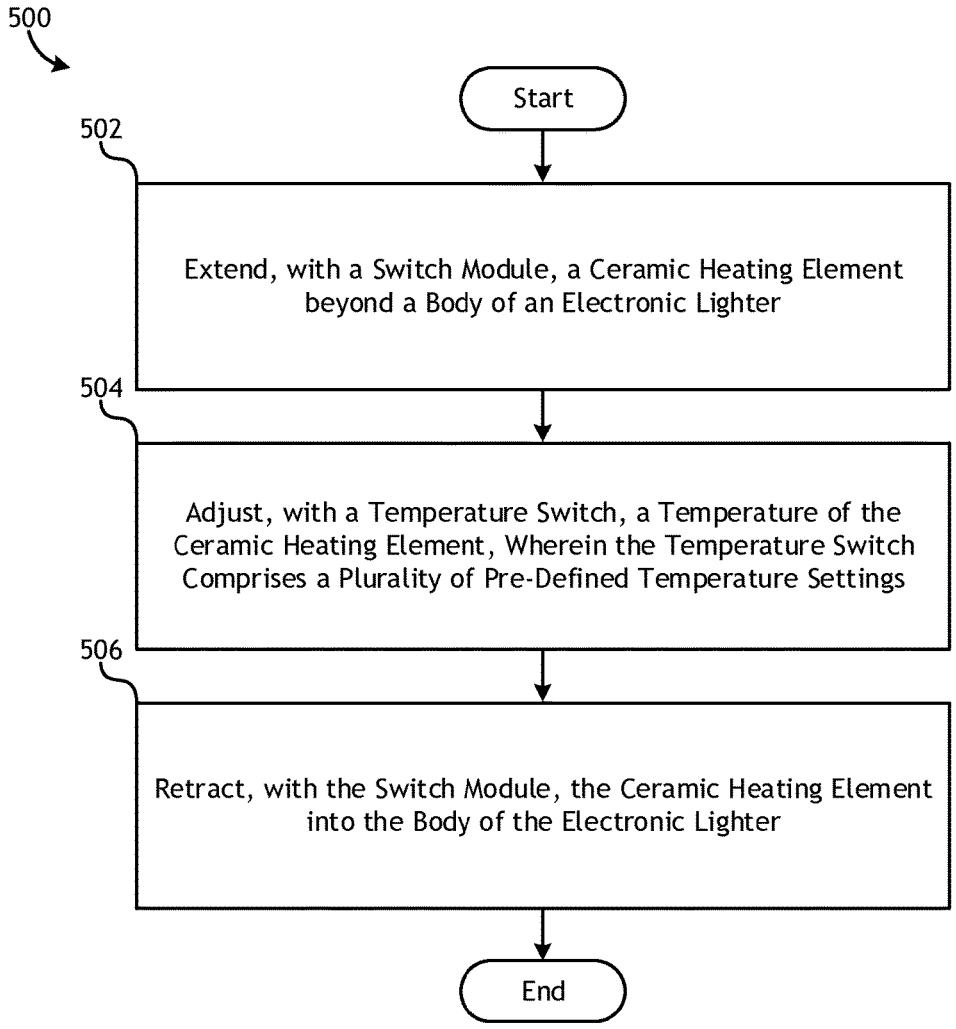
FIG. 5 is a schematic flowchart diagram illustrating one embodiment of a method for a burn proof lighter with a collapsible ceramic tip.

FIG. 5 is a schematic flowchart diagram illustrating one embodiment of a method 500 for a burn proof lighter with a collapsible ceramic tip. At block 502, the method 500 includes extending, with a switch module, a ceramic heating element beyond a body of an electronic lighter. As depicted in block 504, the method 500 includes adjusting, with a temperature switch, a temperature of the ceramic heating element, wherein the temperature switch comprises a plurality of pre-defined temperature settings. As shown in block 506, the method 500 includes retracting, with the switch module, the ceramic heating element into the body of the electronic lighter. In another embodiment, the method may include "pre-heating" the ceramic heating element to a user-defined value prior to signaling the user to extend ceramic heating element. In such an embodiment, an indicator light may emit a first color (e.g., red) during the pre-heating process and then the indicator light may emit a second color (e.g., green) after the pre-heating is complete (i.e., when ceramic heating has reached a temperature setting value corresponding to a current setting of temperature switch and is thus ready for use).

Figure 6:
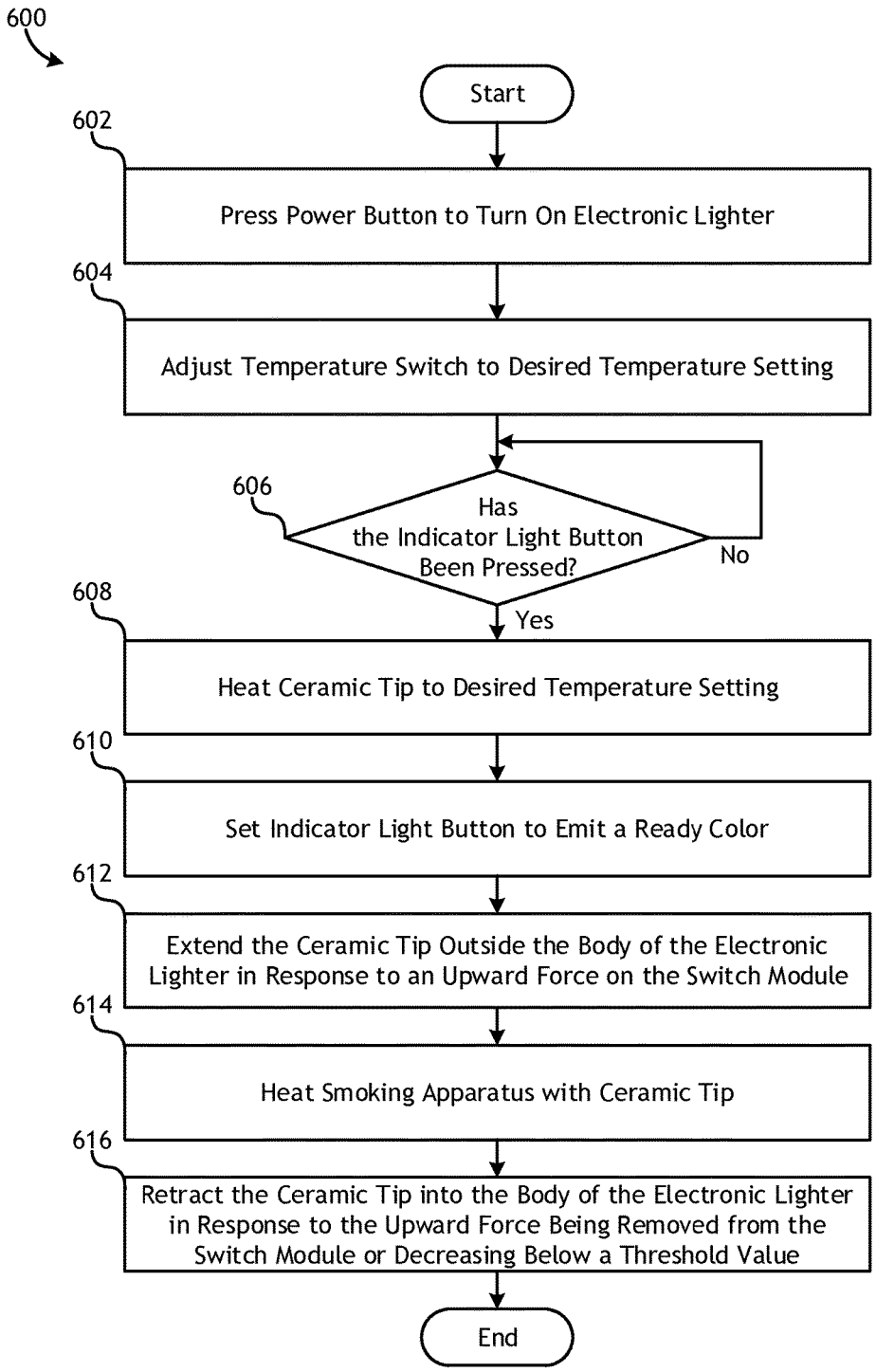
FIG. 6 is a schematic flowchart diagram illustrating one embodiment of a method for a burn proof lighter with a collapsible ceramic tip.

FIG. 6 is a schematic flowchart diagram illustrating one embodiment of a method 600 for a burn proof lighter with a collapsible ceramic tip. At block 602, the method 600 includes a user pressing a power button to turn on an electronic lighter with a collapsible ceramic tip. As depicted in block 604, the method 600 includes a user adjusting a temperature switch to select a desired temperature setting. At block 606, a processor of the electronic lighter determines whether a user has pressed an indicator light button. If the user has not pressed the indicator light button, the processor waits. If the user has pressed the indicator light button, the processor heats the ceramic tip to the desired temperature setting shown on the temperature switch, as shown in block 608.

As depicted in block 610, the processor sets the indicator light button to emit a "ready" color (e.g., green), thereby signaling to the user that the ceramic tip has been heated to the desired temperature and is thus ready for use. As shown in block 612, the user extends the ceramic tip outside (i.e., beyond) the body of the electronic lighter by applying an upward force on the switch module. As depicted in block 614, the user heats a smoking apparatus with the ceramic tip. As shown in block 616, the user retracts the ceramic tip safely into the body of the electronic lighter by removing the upward force from the switch module or decreasing the upward force below a threshold value. In an embodiment, the switch module may include a spring loaded module that automatically retracts the ceramic tip in response to a user removing upward force from the switch module and/or in response to a user decreasing upward force on the switch module to an amount of force that is below a pre-defined threshold value. In this manner, the ceramic tip may only be extended while a user is manually interfacing with the lighter, and the ceramic tip may be automatically withdrawn (i.e., safely retracted) if a user is not manually interfacing with the lighter.

It should be understood that various operations described herein may be implemented in software executed by logic or processing circuitry, hardware, or a combination thereof. The order in which each operation of a given method is performed may be changed, and various operations may be added, reordered, combined, omitted, modified, etc. It is intended that the invention(s) described herein embrace all such modifications and changes and, accordingly, the above description should be regarded in an illustrative rather than a restrictive sense.

Although the invention(s) is/are described herein with reference to specific embodiments, various modifications and changes can be made without departing from the scope of the present invention(s), as set forth in the claims below. Accordingly, the specification and figures are to be regarded in an illustrative rather than a restrictive sense, and all such modifications are intended to be included within the scope of the present invention(s). Any benefits, advantages, or solutions to problems that are described herein with regard to specific embodiments are not intended to be construed as a critical, required, or essential feature or element of any or all the claims.

Unless stated otherwise, terms such as "first" and "second" are used to arbitrarily distinguish between the elements such terms describe. Thus, these terms are not necessarily intended to indicate temporal or other prioritization of such elements. The terms "coupled" or "operably coupled" are defined as connected, although not necessarily directly, and not necessarily mechanically. The terms "a" and "an" are defined as one or more unless stated otherwise. The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system, device, or apparatus that "comprises," "has," "includes" or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations.

The invention claimed is:

1. A system for a burn proof lighter with a collapsible ceramic tip, comprising:

a body configured to support one or more components of the burn proof lighter, the body comprising insulation to protect a user from burns from heat emitted by one or more components of the burn proof lighter;

a switch module coupled to the body and configured to: extend a ceramic heating element from the body; and retract the ceramic heating element into the body; and a temperature switch coupled to the body and configured to adjust a temperature of the ceramic heating element, wherein the temperature switch comprises a plurality of pre-defined temperature settings in a temperature range between three hundred and eighty (380) degrees Fahrenheit and one-thousand four-hundred (1400) degrees Fahrenheit.

2. The system of claim 1, wherein the switch module further comprises a sliding switch configured to:

extend the ceramic heating element in response to an upward force applied to the sliding switch by the user; and retract the ceramic heating element automatically in response to the upward force being removed or decreasing below a threshold value.

3. The system of claim 1, wherein the switch module further comprises a spring activated push button module.

4. The system of claim 1, wherein the temperature switch further comprises a plus button and a minus button.

5. The system of claim 1, wherein the plurality of pre-defined temperature settings further comprises:

a vapor setting corresponding to three-hundred eighty (380) degrees Fahrenheit;

a thick vapor setting corresponding to four-hundred thirty (430) degrees Fahrenheit;

a combustion setting corresponding to seven-hundred fifty (750) degrees Fahrenheit; or a butane lighter setting corresponding to one-thousand four-hundred (1400) degrees Fahrenheit.

6. The system of claim 1, wherein the plurality of pre-defined temperature settings further comprises:

a low temperature setting;

a medium temperature setting; and a high temperature setting.

7. The system of claim 1, wherein the plurality of pre-defined temperature settings further comprises a customizable range of temperature setting values.

8. An apparatus for a burn proof lighter with a collapsible ceramic tip, comprising:

a body configured to support one or more components of the burn proof lighter;

a switch module coupled to the body and configured to: extend a ceramic heating element from the body; and retract the ceramic heating element into the body; and a temperature switch coupled to the body and configured to adjust a temperature of the ceramic heating element, wherein the temperature switch comprises a plurality of pre-defined temperature settings in a temperature range between three hundred and eighty (380) degrees Fahrenheit and one-thousand four-hundred (1400) degrees Fahrenheit.

9. The apparatus of claim 8, wherein the switch module further comprises a sliding switch configured to:

extend the ceramic heating element in response to an upward force applied to the sliding switch by the user; and retract the ceramic heating element automatically in response to the upward force being removed or decreasing below a threshold value.

10. The apparatus of claim 8, wherein the temperature switch further comprises a plus button and a minus button.

11. The apparatus of claim 8, wherein the plurality of pre-defined temperature settings further comprises:

a vapor setting corresponding to three-hundred eighty (380) degrees Fahrenheit;

a thick vapor setting corresponding to four-hundred thirty (430) degrees Fahrenheit;

a combustion setting corresponding to seven-hundred fifty (750) degrees Fahrenheit; or a butane lighter setting corresponding to one-thousand four-hundred (1400) degrees Fahrenheit.

12. The apparatus of claim 8, wherein the plurality of pre-defined temperature settings further comprises:

a low temperature setting;

a medium temperature setting; and a high temperature setting.

13. The apparatus of claim 8, wherein the plurality of pre-defined temperature settings further comprises a customizable range of temperature setting values.

* * * * *